US009126814B2

(12) United States Patent
Tarasoff

(10) Patent No.: US 9,126,814 B2
(45) Date of Patent: Sep. 8, 2015

(54) RETRACTABLE FUNNEL

(71) Applicant: Cary Lyn Tarasoff, Saskatoon (CA)

(72) Inventor: Cary Lyn Tarasoff, Saskatoon (CA)

( * ) Notice: Subject to any disclaimer, the term of this patent is extended or adjusted under 35 U.S.C. 154(b) by 273 days.

(21) Appl. No.: 13/896,645

(22) Filed: May 17, 2013

(65) Prior Publication Data

US 2014/0338787 A1 Nov. 20, 2014

(51) Int. Cl.
*B67C 11/02* (2006.01)

(52) U.S. Cl.
CPC ..... *B67C 11/02* (2013.01); *Y10T 29/49826* (2015.01)

(58) Field of Classification Search
CPC ..... B67C 11/00; B67C 11/02
USPC ..... 141/331–345; 222/539, 527–530
See application file for complete search history.

(56) References Cited

U.S. PATENT DOCUMENTS

| | | | | |
|---|---|---|---|---|
| 1,209,051 A | | 12/1916 | Shotwell | |
| 1,420,039 A | | 6/1922 | Horstkotte | |
| 1,461,654 A | | 7/1923 | Haesslek | |
| 1,563,005 A | * | 11/1925 | Allee | 141/338 |
| 2,667,117 A | * | 1/1954 | Millard et al. | 99/418 |
| 5,857,504 A | * | 1/1999 | Tremblay | 141/338 |
| 6,152,198 A | * | 11/2000 | Nguyen | 141/337 |
| 7,322,386 B2 | * | 1/2008 | Holm | 141/338 |
| 2012/0103466 A1 | | 5/2012 | Castillo | |

FOREIGN PATENT DOCUMENTS

| | | |
|---|---|---|
| CA | 2271501 | 11/1999 |
| EP | 1680351 | 7/2006 |
| GB | 230659 | 3/1925 |

* cited by examiner

*Primary Examiner* — Timothy L Maust
*Assistant Examiner* — Timothy P Kelly
(74) *Attorney, Agent, or Firm* — Ryan W. Dupuis; Kyle R. Satterthwai; Ade & Company Inc.

(57) ABSTRACT

A funnel body comprising a base plate, pull rod, and an outer wall. The outer wall may comprise a plurality of overlapping leaves or a membrane joined to a frame, with the outer wall movable between a collapsed position and an extended position and optionally biased towards the extended position. The funnel body may be moved into an extended position for use as a funnel and moved into a collapsed position and further retracted into a receptacle for storage within the receptacle when not in use. Also provided is a funnel assembly, comprising the funnel body and a housing, wherein the base plate of the funnel body is housed within the housing and positioned between upper and lower stops that engage the base plate and thereby prevent the base plate from exiting the housing. Further provided is a receptacle in combination with the funnel assembly and a method for modifying a receptacle to include a funnel assembly.

5 Claims, 11 Drawing Sheets

RETRACTABLE FUNNEL

FIELD

This disclosure relates to the field of funnels and more particularly to collapsible funnels that can be retracted into a receptacle.

BACKGROUND

Funnels are commonly used to transfer liquid goods into a receptacle, particularly a receptacle with a narrow mouth or spout that makes it difficult to pour directly into the receptacle with accuracy. Funnels have traditionally been designed as portable devices that can be readily moved and used with any receptacle of suitable size. The difficulty with portable funnels is that they are easy to misplace and may not be readily available when needed. Further, the use of a single funnel for multiple liquids can lead to cross-contamination. A solution to these problems has been to provide collapsible funnels that are joined to a receptacle and that can be collapsed and retracted within the neck or spout of the receptacle when not in use. Such funnels have been set forth, for example, in CA2271501, EP1680351, GB230659, U.S. Pat. No. 1,209,051, U.S. Pat. No. 1,420,039, U.S. Pat. No. 1,461,654, and US20120103466.

While these funnels are suitable for their intended purpose, there remains a desire for a retractable funnel that is reliable, durable, and readily incorporated into new or existing receptacles.

SUMMARY

A first embodiment is a funnel body comprising a base plate having an upper surface, a lower surface, and an outer edge, said base plate comprising at least one opening to allow passage of a liquid through said base plate; a pull rod joined to the base plate; and an outer wall joined to the upper surface of the base plate, wherein the funnel is for use with a receptacle, the outer wall is movable between a collapsed position and an extended position, and the funnel is storable within the receptacle when in the collapsed position.

In an embodiment, the base plate is substantially planar.

In a further embodiment, the position at which the outer wall is joined to the upper surface of the base plate is spaced inward from the outer edge of the base plate.

In an embodiment, the outer wall comprises a plurality of leaves joined to the upper face of the base plate in an overlapping relationship and wherein each leaf has an inner face, an outer face, and opposite side edges; each leaf extends upward from the upper surface of the base plate; the leaves are sufficiently rigid to be self-supporting in the extended position; and the leaves together form a continuous wall that extends upward from the upper face of the base plate.

In a further embodiment, the leaves are biased towards the extended position.

In an embodiment, the leaves are pivotally joined to the upper face of the base plate. In an additional embodiment, the funnel body further comprises a plurality of springs, wherein at least one spring is joined to the outer face of each leaf and said spring is further joined to the base plate at a position that is closer to the periphery of the base plate than the position at which the leaf is joined to the base plate, said spring biasing the leaf towards the extended position.

In an embodiment, the leaves are fixedly joined to the base plate.

In an embodiment, the leaves are sufficiently resilient to flex between the collapsed position and the extended position.

In a further embodiment, the length of each leaf is less than or equal to the width of the base plate.

In yet another embodiment, the outer wall comprises a frame joined to the base plate and extending upward relative to the upper surface of the base plate and a membrane joined to the frame, said membrane having a lower edge.

In an embodiment, the membrane is joined to the frame such that the lower edge of the membrane is spaced apart from the upper surface of the base plate. In a further embodiment, the frame is biased towards the extended position.

In an embodiment, the frame comprises a plurality of ribs. In a further embodiment, each rib is individually joined to the base plate.

In an embodiment, the membrane is self-biased to return to a particular arrangement each time the outer wall of the funnel body is moved to the collapsed position.

In an embodiment, the base plate of the funnel body comprises a plurality of apertures distributed over the base plate.

Yet another embodiment is a funnel assembly comprising a housing having a side wall, said side wall having an inner surface and an outer surface; an upper end; a lower end; an upper end portion; a lower end portion; and a length extending along the longitudinal axis between the upper end and the lower end; at least one upper stop within the upper end portion of the inner surface of the housing; at least one lower stop within the lower end portion of the inner surface of the housing; and a funnel body of the disclosure, wherein the base plate of the funnel body is situated within the housing between the upper and lower stops such that the base plate is free to slide longitudinally within the housing between the upper and lower stops but is prevented from moving beyond the upper and lower stops by engagement with the upper and lower stops; movement of the base plate towards the upper end of the housing allows the outer wall of the funnel body to extend from the upper end of the housing; and movement of the base plate towards the lower end of the housing allows the outer wall of the funnel body to retract within the housing.

In an embodiment of the funnel assembly, the upper stop is positionable between a retention position in which the at least one upper stop is positioned to engage the base plate as the base plate is moved longitudinally towards the upper end of the housing and a release position in which the at least one upper stop is positioned to not engage the base plate as the base plate is moved longitudinally towards the upper end of the housing, thereby allowing the funnel body to be removed from the housing when the upper stop is in the release position.

In a further embodiment of the funnel assembly, at least one upper stop is movable into the release position by retraction of the upper stop into the side wall of the housing, by repositioning of the upper stop, or by removal of the upper stop from the housing.

In an embodiment of the funnel assembly, the outer edge of the base plate is in contact with the inner surface of the housing along substantially the full length of the outer edge of the base plate, thereby inhibiting liquid from passing between the outer edge of the base plate and the inner surface of the housing.

A further embodiment is a funnel assembly of the disclosure in combination with a receptacle.

Another embodiment is a funnel assembly of the disclosure in combination with a receptacle having a mouth, neck, or spout; wherein the funnel assembly is situated within the mouth, neck, or spout of the receptacle to allow the outer wall of the funnel body to extend beyond the upper end of said mouth, neck, or spout when the funnel body is extended.

In an embodiment, the housing is integral with the receptacle.

In an embodiment, the housing is formed by the mouth, neck, or spout of the receptacle.

In an embodiment, the housing is joined to receptacle.

Yet another embodiment is a method for modifying a receptacle to include a retractable funnel comprising inserting a funnel assembly of the disclosure into an opening within the receptacle and securing the funnel assembly to the receptacle, with the funnel assembly arranged to allow at least a portion of the outer wall of the funnel body to extend outward from the receptacle when the funnel body is moved to the extended position.

In an embodiment, the opening within the receptacle into which the funnel assembly is inserted is a mouth, neck, or spout of the receptacle.

In a further embodiment of the method, the step of securing the funnel assembly to the receptacle comprises frictionally securing the funnel assembly to the receptacle.

DESCRIPTION

Figure 1:
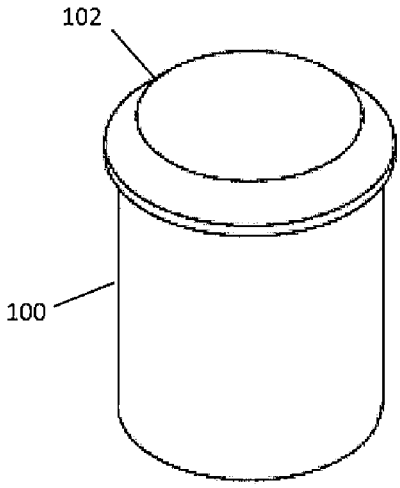
FIG. 1 depicts a perspective view of a first embodiment of a funnel assembly.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. Further, where considered appropriate, reference numerals may be repeated among the figures to indicate corresponding or analogous elements.

Provided generally is a funnel body for use with a receptacle, where the funnel body is arranged to be stored in a collapsed position retracted within the receptacle when not in use and can be extended from an opening within the receptacle into an extended position when required for use as a funnel to transfer a pourable good into the receptacle. Further provided is a funnel assembly comprising the funnel body in combination with a housing, said housing comprising upper and lower stops that retain a base of the funnel body within the housing while allowing the base of the funnel body to be moved longitudinally along the length of the housing between the upper and lower stops. Also provided is the funnel body or funnel assembly in combination with a receptacle.

The figures depict two general embodiments of a funnel body 101; a first embodiment having an outer wall made up by a plurality of overlapping leaves 200, as shown in FIGS. 1 to 17, and a second embodiment having an outer wall comprising a membrane 1902 joined to a plurality of ribs 1900, as shown in FIGS. 18 to 33. In an embodiment, the leaves 200 or ribs 1900 are biased towards an extended position.

Apart from the components forming the outer wall of the funnel body 101, the remaining components of each embodiment of the funnel body 101 and funnel assembly 901 are substantially identical and the descriptions of these components are intended to be applied to all embodiments.

The funnel body 101 comprises a base plate 500, pull rod 202, and an outer wall comprising either a plurality of overlapping leaves 200 or a membrane 1902 joined to a plurality of ribs 1900. The funnel body 101 is intended for use with a housing 100 comprising at least one upper stop 502 and at least one lower stop 504 and optionally comprising a lid 102. The funnel body 101 and the housing 100 together make up a funnel assembly 901.

A first embodiment of a funnel body 101 and funnel assembly 901 is shown in FIGS. 1 to 17. In this embodiment, the funnel body 101 comprises a plurality of leaves 200 joined to a base plate 500. Each leaf 200 has a width in the direction running parallel to the upper face of the base plate 500 and a length in the direction extending upward from the upper face 500 of base plate. Each leaf 200 comprises a lower end, an upper end, and opposing side edges; wherein the lower end is joined to the base plate 500. The lower end of each leaf 200 may be fastened to the base plate 500 or the lower end of each leaf may be integral with the base plate 500. For example, the base plate 500 and leaves 200 may be molded together. In another embodiment, the base plate 500 and leaves 200 may be fastened together using any suitable adhesive or fastener as will readily be apparent to a person skilled in the art. The base plate 500 and leaves 200 may comprise the same material, or the base plate 500 and leaves 200 may comprise different materials.

In an embodiment, the lower end of each leaf 200 is fixedly joined to the base plate 500, while in another embodiment the lower end of each leaf 200 is pivotally joined to the base plate 500. In an embodiment, each leaf 200 is joined to the upper face of the base plate 500 at a position that is spaced inward from the outer edge of the base plate 500. For example, each leaf 200 may be joined to the upper surface of the base plate 500 at a position that is spaced inward from the outer edge of the base plate 500 by a distance that is sufficient to allow the upper stop 502 and lower stop 504 to engage the outer portion of the base plate without engaging the leaves 200 at the point where each leaf 200 is joined to the upper surface of the base plate 500. In another embodiment, each leaf 200 may be joined to the upper surface of the base plate 500 at a position that is spaced inward from the outer edge of the base plate 500 by a distance greater than or equal to about 1%, 2.5%, 5%, 7.5%, 10%, 12.5%, 15%, 17.5%, 20%, or more of the width of the base plate 500.

In an embodiment, the base plate 500 is circular and the leaves 200 are joined to the upper surface of the base plate in a circumferential arrangement, with adjacent leaves 200 circumferentially overlapping along their side edges and the lower end of each leaf 200 joined to the upper face of the base plate 500 adjacent to its periphery but spaced apart from the outer edge of the base plate 500 to an extent sufficient to allow an outer edge portion of the base plate 500 to engage the upper stop 502 and the lower stop 504 when the funnel body 101 is housed within a housing 100. The overlapping leaves 200 together form a continuous outer wall extending upward from the upper face of the base plate 500. The outer wall of the funnel is considered to be a continuous outer wall if all of the adjacent leaves 200 overlap along their side edges to form an uninterrupted outer wall.

The side edges of the leaves 200 are tapered, with the lower end of each leaf 200 having a lesser width than the upper end of each leaf 200. This allows the side edges of adjacent leaves 200 to overlap in both the collapsed and extended position, with greater overlap between the side edges of adjacent leaves 200 in the collapsed position than in the extended position. The leaves 200 should comprise a rigid or semi-rigid material, thereby allowing the leaves 200 to be self-supporting in the extended position. The leaves 200 may further comprise a curvature along the longitudinal and/or lateral axis to enable the side edges of each leaf 200 to be in contact with the outer surface of each adjacent leaf substantially along its full length, preventing material from exiting the funnel body 101 by passing between adjacent leaves 200. In an embodiment, the leaves 200 may be preformed to enhance a seal between successive overlapping leaves 200. The slope of the outer wall of the funnel body 101 in the extended position should be greater than zero degrees and less than 90 degrees, relative to the longitudinal axis of the pull rod 202, and may be selected depending on the viscosity of the fluid to be poured through the funnel body 101, the size of the aperture(s) in the base plate 500, the flow rate, and the properties of the materials from which the leaves 200 are constructed. In an embodiment, the slope of the outer wall of the funnel body 101, relative to the longitudinal axis of the pull rod 202, is between about 25 degrees and about 65 degrees.

The material from which the leaves 200, base plate 500, and pull rod 202 are formed may be selected based upon the type of substance(s) with which the funnel body 101 is intended for use. For example, if the funnel body 101 is intended for use with a corrosive substance, then the leaves 200, base plate 500, and pull rod 202 may be selected from a material that is corrosion resistant. If the funnel body 101 is intended for use with a hot substance, then the leaves 200, base plate 500, and pull rod 202 may be made of a heat resistant material. Examples of suitable materials include, but are not limited to, plastic; metals such as stainless steel, mild steel, brass, bronze, copper, titanium, and aluminum; composite materials; rubber; fiberglass, ceramic, glass, and wood.

Figure 2:
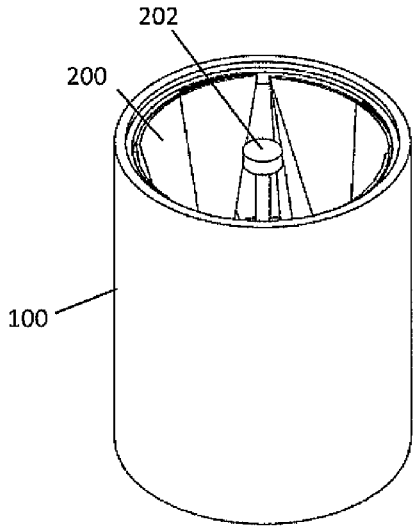
FIG. 2 depicts a perspective view of the funnel assembly of FIG. 1, with the lid removed.
Figure 3:
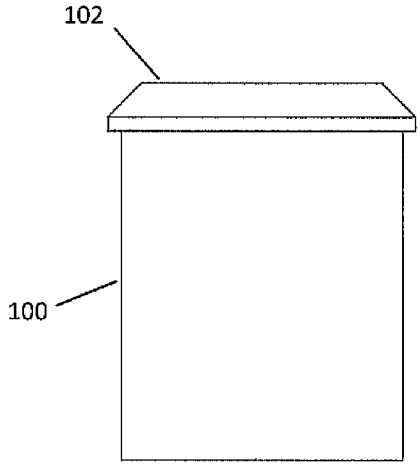
FIG. 3 depicts an elevation view of the funnel assembly of FIG. 1.
Figure 4:
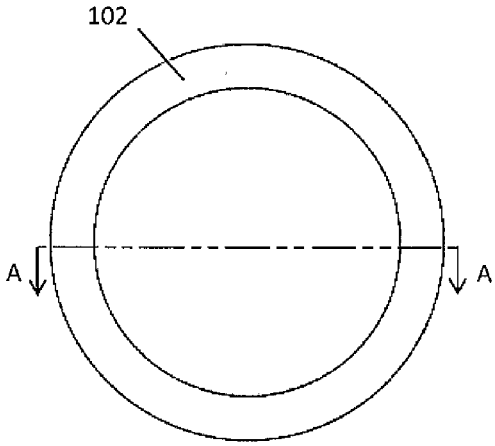
FIG. 4 depicts a top plan view of the funnel assembly of FIG. 1.
Figure 5:
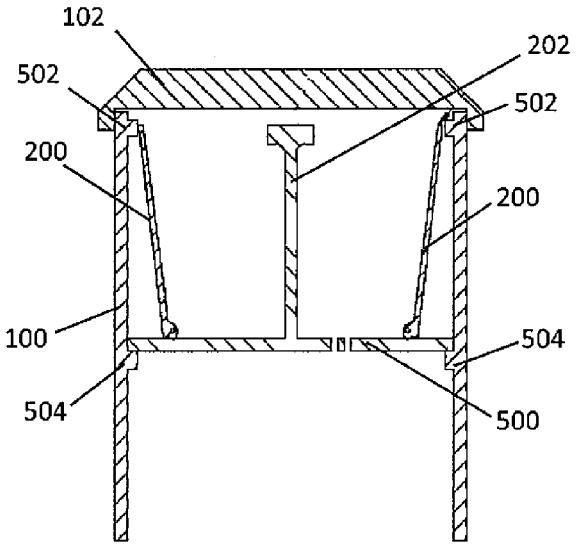
FIG. 5 depicts a sectional view of the funnel assembly of FIG. 1, sectioned along line A as shown in FIG. 4.
Figure 6:
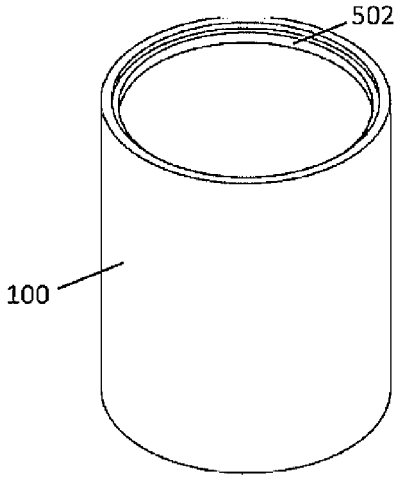
FIG. 6 depicts a perspective view of an embodiment of a housing.
Figure 7:
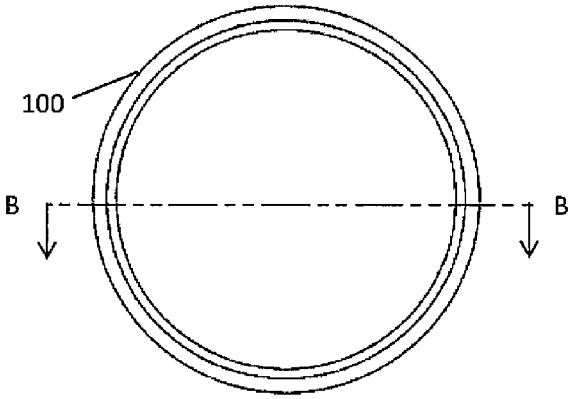
FIG. 7 depicts a top plan view of the housing of FIG. 6.
Figure 8:
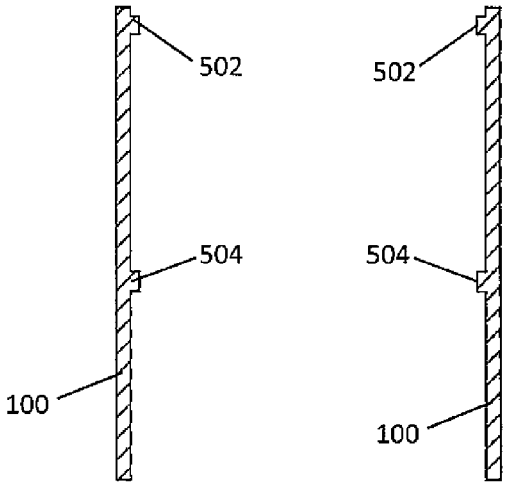
FIG. 8 depicts a sectional view of the housing of FIG. 6, sectioned along line B as shown in FIG. 7.
Figure 9:
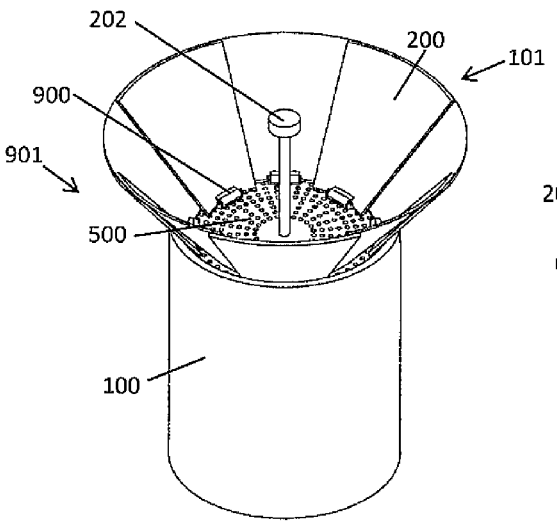
FIG. 9 depicts a perspective view of the funnel assembly of FIG. 9, with the funnel in the extended position.
Figure 10:
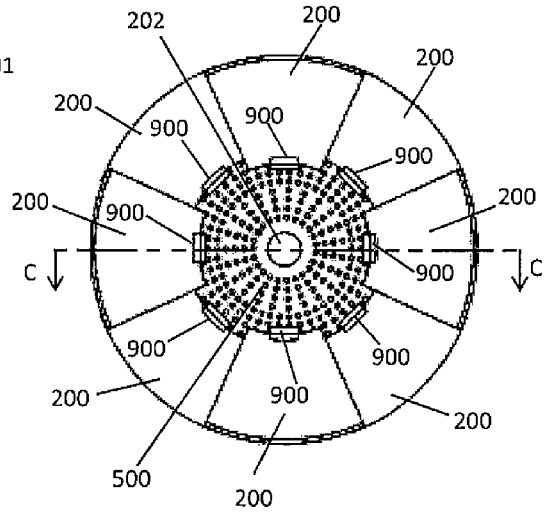
FIG. 10 depicts a top plan view of an embodiment of a funnel assembly, with the funnel in the extended position.
Figure 11:
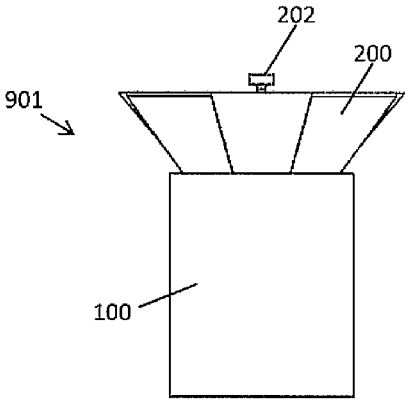
FIG. 11 depicts an elevation view of the funnel assembly of FIG. 9, with the funnel in the extended position.
Figure 12:
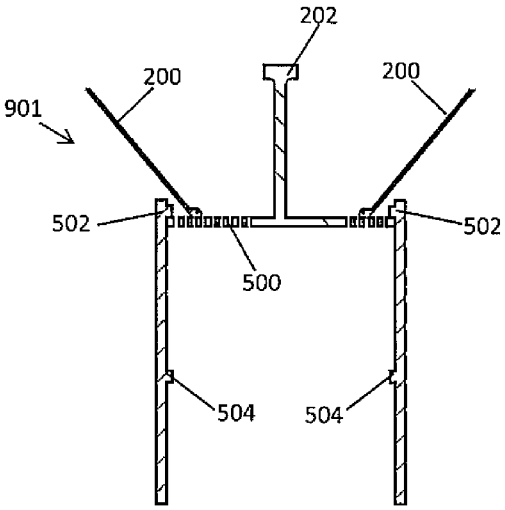
FIG. 12 depicts a sectional view of the funnel assembly of FIG. 9, sectioned along line C as shown in FIG. 10.
Figure 13:
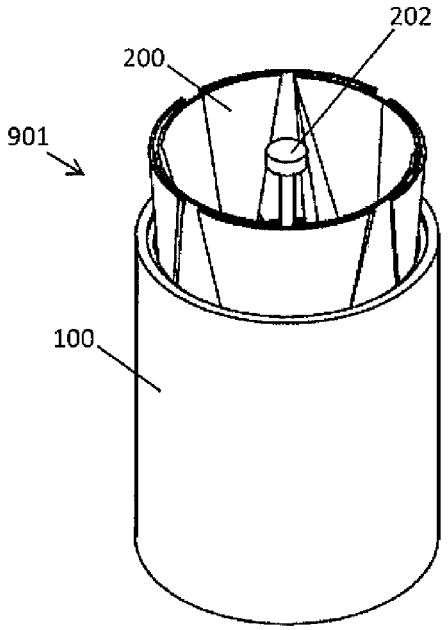
FIG. 13 depicts a perspective view of the funnel assembly of FIG. 9, with the funnel in a partially extended position.
Figure 14:
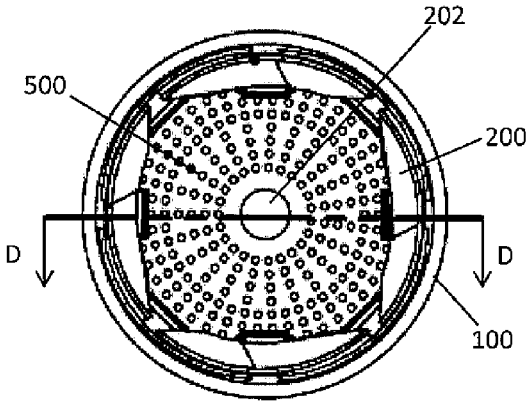
FIG. 14 depicts a top plan view of the funnel assembly of FIG. 9, with the funnel in a partially extended position.
Figure 15:
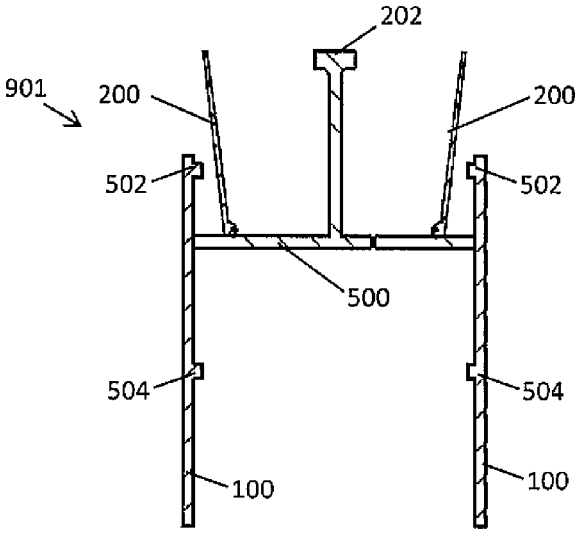
FIG. 15 depicts a sectional view of the funnel assembly of FIG. 9, with the funnel in a partially extended position and sectioned along line D as shown in FIG. 14.
Figure 16:
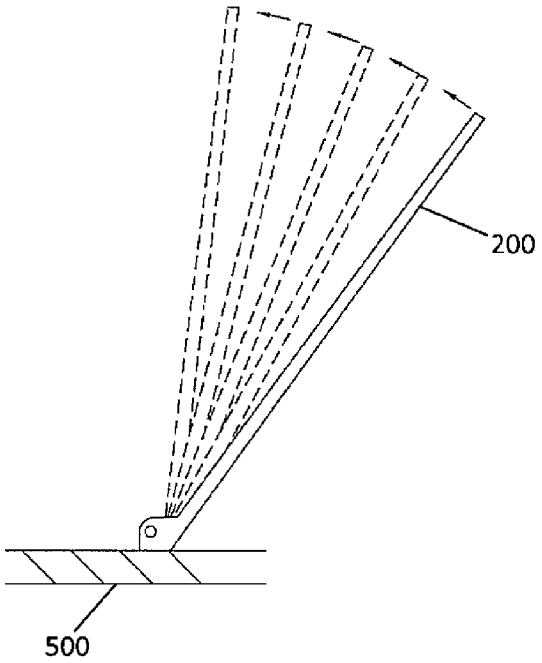
FIG. 16 depicts a partial view of the funnel shown in FIG. 9, showing a side elevation view of a single leaf joined to the base plate, with the base of the leaf fixedly joined to the base plate.
Figure 17:
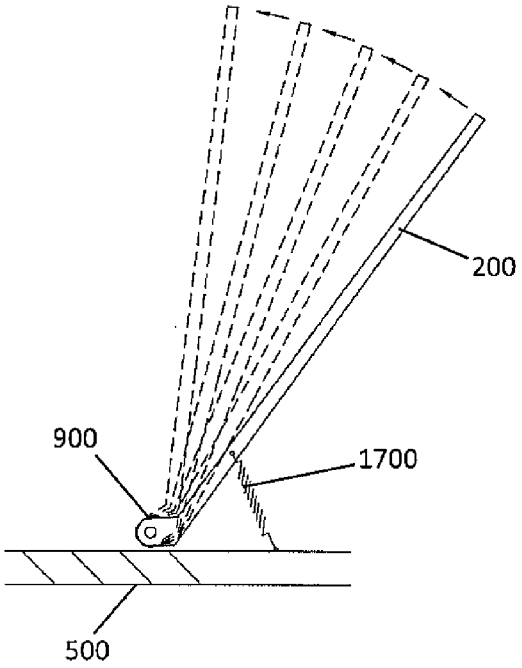
FIG. 17 depicts a partial view of an alternate embodiment of the funnel shown in FIG. 9, showing a side elevation view of a single leaf joined to the base plate, with the base of the leaf pivotally joined to the base plate.
Figure 18:
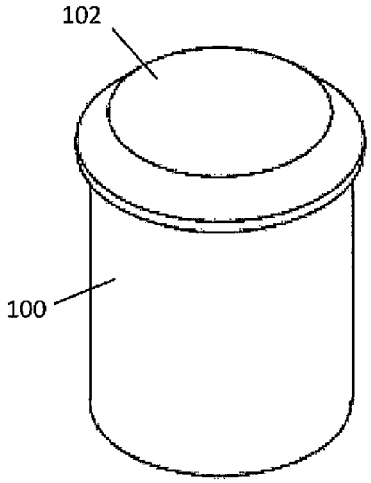
FIG. 18 depicts a perspective view of a second embodiment of a funnel assembly.

FIGS. 2 and 5 depict the first embodiment of the funnel body 101 in a retracted position, FIGS. 13-15 depict the funnel body 101 in a partially extended position, and FIGS. 9-12 depict the funnel body 101 in an extended position. In one embodiment, the leaves 200 are biased towards the extended position. In an embodiment, for example the embodiment depicted in FIG. 16, the base of each leaf 200 is fixedly joined to the base plate 500 and the leaves 200 comprise a resilient material that is able to repeatedly flex between the extended position and the collapsed position, but is biased towards the extended position. In another embodiment, for example the embodiment depicted in FIG. 17, the base of each leaf 200 is joined to the base plate 500 by a pivot 900 and the outer face of each leaf 200 is further joined to base plate 500 by an elastic member 1700 that biases the leaf 200 towards the extended position. In an embodiment, the elastic member 1700 is a spring, for example a plastic or metal spring, or an elastic cord.

In another embodiment, the leaves 200 may be unbiased. In this embodiment, movement of the leaves from the collapsed to the extended position may be effected by gravity or upon application of pressure to push the leaves 200 towards the extended position. For example, a user could manually push the leaves 200 into the extended position after pulling upwards on the pull rod 202 to release the outer wall of the funnel from engagement with the housing 100. Movement of the leaves 200 to the collapsed position could be effected by pushing on the pull rod 202 to bring the leaves 200 into engagement with the housing 100 or by manually applying pressure to the leaves 200 to move the leaves from the extended position into the collapsed position.

In an embodiment, the range of movement of the leaves 200 between the retracted and extended positions is limited to a predetermined range, such that the leaves 200 cannot move outward beyond a predetermined extended position and/or inward beyond a predetermined retracted position. For example, the angle of the leaves 200 relative to the longitudinal axis of the pull rod 202 may range from zero to less than 90 degrees, between the collapsed and extended positions, including all ranges between these values. In an embodiment, the angle of the leaves 200 relative to the longitudinal axis of the pull rod 202 may be between zero to about 20 degrees in the collapsed position and between about 30 to about 65 degrees in the extended position. These values are provided merely as examples and it is to be understood that the angles of the collapsed and extended positions may be selected to be any suitable angle as desired or as required to suit any particular flowable good with which the funnel body 101 is intended for use.

When the leaves 200 are fixedly joined to the upper face of the base plate 500, this range of motion may be determined by the geometry and/or degree of flexibility of the leaves 200. When the leaves 200 are pivotally joined to the upper face of the base plate 500, the range of motion of the leaves may be determined by the range of motion of the pivot 900. The maximum angle of the leaves 200 in the extended position may also be determined by the point at which the leaves 200 engage the upper end of the housing 100 if the upper stop 502 is positioned to engage the base plate 500 at a position sufficiently distant from the upper end of the housing 100 to prevent the leaves 200 from completely exiting the housing 100 when the pull rod 202 is pulled towards the upper end of the housing 100. The desired range of motion of the leaves 200 may be determined by the design requirements of the fluid to be transferred through the funnel body 101, the size of the opening of the housing 100, the distance between the upper stop 502 and the lower stop 504 and finally, the leaf 200 size and the position at which each row of overlapping leaves 200 is attached to the base plate 500 by way of a connection or pivot 900. The leaves 200 should only open and close within a maximum working angle of greater than zero and less than 90 degrees relative to the longitudinal axis of the pull rod 202. As described herein and shown in the accompanying figures, the outer wall formed of leaves 200 is joined to the upper surface of the base plate so as to be movable between an extended position operable as a funnel with an overall diameter greater than the housing and a collapsed position in which the outer wall is radially collapsed relative to the extended position so as to be storable within the housing. Movement of the base plate towards the upper end of the housing allows the outer wall of the funnel body to extend from the upper end of the housing such that the outer wall is movable from the collapsed position to the extended position, whereas movement of the base plate towards the lower end of the housing allows the outer wall of the funnel body to retract within the housing from the extended position to the collapsed position. As further shown in the accompanying figures, the outer wall comprises a plurality of first leaves and a plurality of second leaves which are rigid and self-supporting in the extended position. Each first leaf is pivotally supported on the base plate at a first radial distance relative to a center of the base plate and so as to be circumferentially spaced apart from other ones of the first leaves in the extended position. Each second leaf is pivotally supported on the base plate at a second radial distance relative to the center of the base plate which is greater than the first radial distance and so as to be circumferentially spaced apart from other ones of the second leaves in the extended position. More particularly each second leaf spans a circumferential gap between a respective adjacent pair of the first leaves in an overlapping configuration with an outer side of each first leaf of the adjacent pair of the first leaves such that the first and second leaves form a continuous wall that extends upward from the upper face of the base plate in the extended position.

A second embodiment of a funnel body 101 and funnel assembly 901 is shown in FIGS. 18 to 30. In this embodiment, the funnel body 101 comprises a membrane 1902 joined to a plurality of ribs 1900, wherein the membrane 1902 and ribs 1900 together form a continuous outer wall and the base of each rib 1900 is further joined to a base plate 500. The ribs 1902 may be biased towards the extended position. The membrane 1902 may be attached to the outside, inside or inline of the ribs 1900. The membrane 1900 is preferably not attached to the base plate 500. Further it is preferred that the upper stop 502 be positioned such that when the outer wall of the funnel body 101 is in a fully extended position, the unsecured bottom of the membrane 1902 and the space between bottom of the membrane 1902 and the top of the base plate 500 be maintained below the upper end of the housing 100 to ensure that any fluid passing between the lower edge of the membrane 1902 and the base plate 500 is retained within the housing 100 such that no fluid escapes the system when the funnel assembly 901 is in use.

Figure 28:
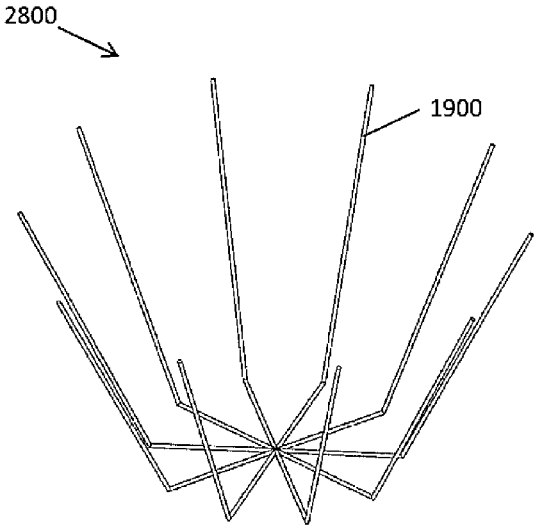
FIG. 28 depicts a partial view of the funnel assembly of FIG. 18, detailing the ribs.
Figure 29:
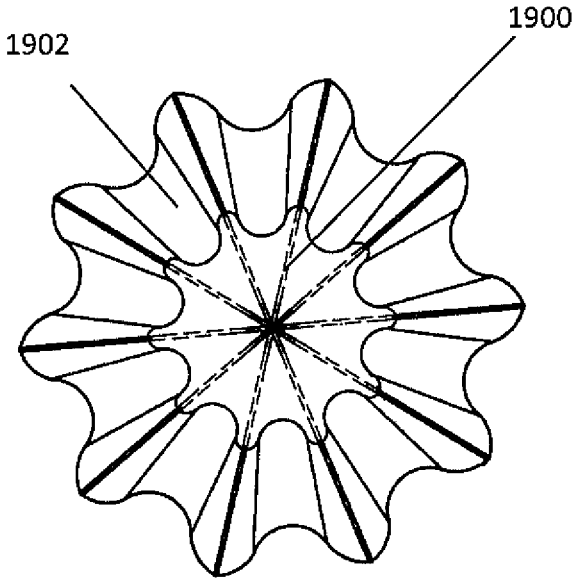
FIG. 29 depicts a top plan view of the funnel assembly of FIG. 18 in a partially extended position.
Figure 30:
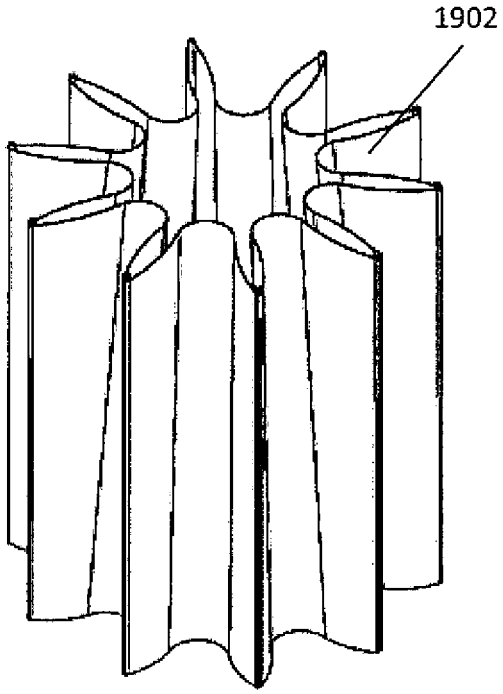
FIG. 30 depicts a partial view of the funnel assembly of FIG. 18, detailing the membrane.
Figure 31:
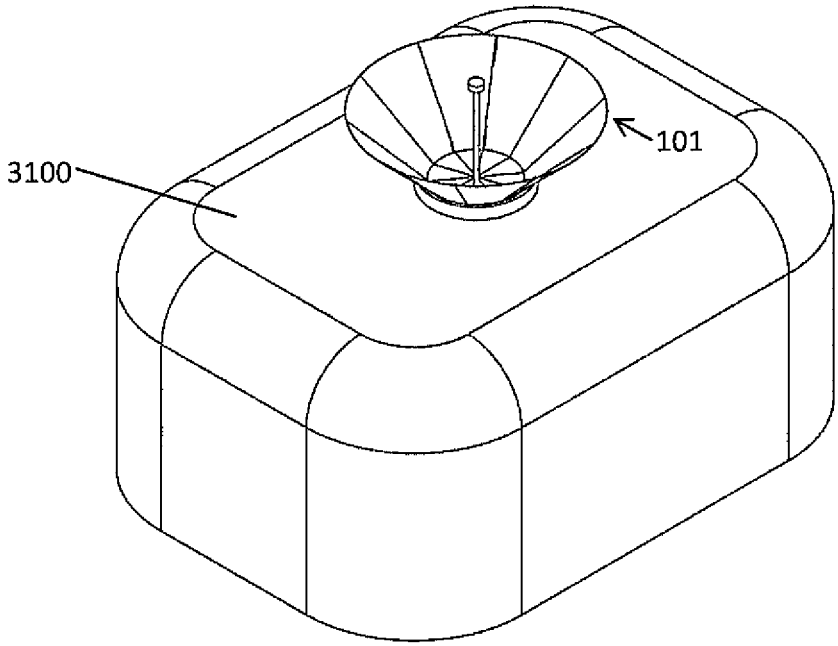
FIG. 31 depicts a perspective view of the funnel assembly of FIG. 18, with the funnel in the extended position, installed within the mouth of a receptacle.
Figure 32:
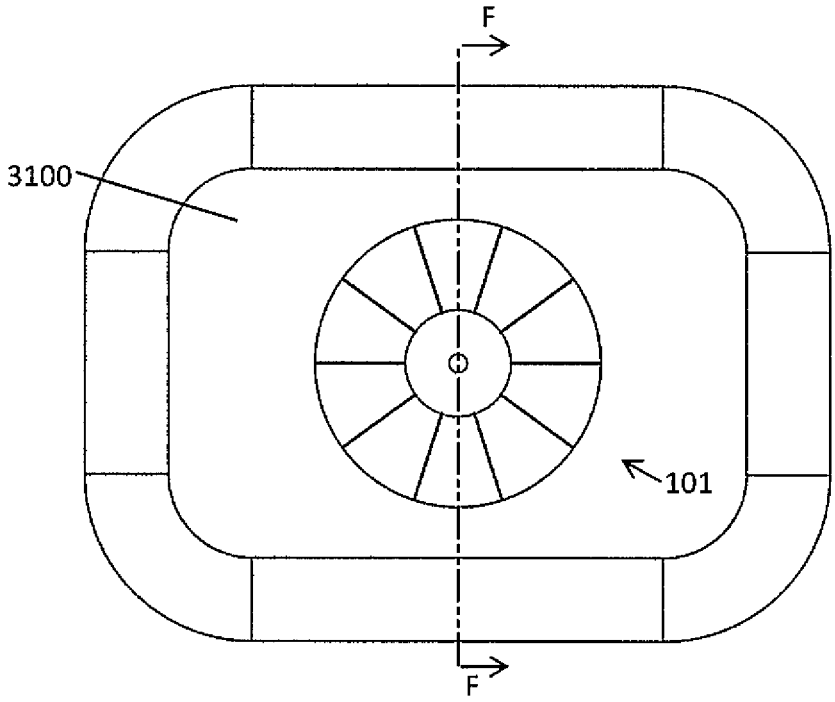
FIG. 32 depicts a top plan view of the funnel assembly of FIG. 18, with the funnel in the extended position, installed within the mouth of a receptacle.
Figure 33:
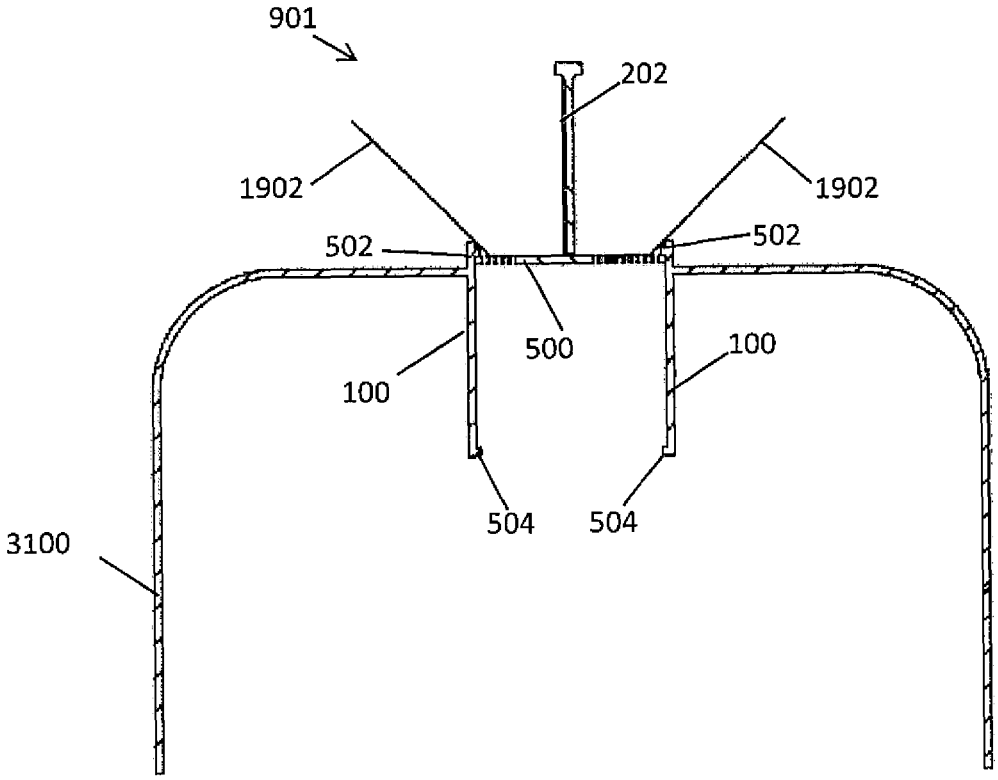
FIG. 33 depicts a sectional view of the funnel assembly of FIG. 18, with the funnel in the extended position, installed within the mouth of a receptacle; sectioned along line F as shown in FIG. 32.

In an embodiment, the ribs 1900 are comprised within a frame 2800, for example as shown in FIG. 28, said frame 2800 joined to the base plate 500. The frame 2800 comprises a plurality of ribs 1900, each rib 1900 having an upward extending portion that extends upward from the base plate 500 and a base portion that extends parallel to the base plate 500. The base portion of each of the plurality of ribs 1900 together makes up a base portion of the frame 2800. The base portion of the frame 2800 may be joined to the upper face of the base plate 500. In an embodiment, the base portion of the frame 2800 is releasably joined to the upper face of the base plate 500, while in another embodiment the base portion of the frame 2800 is permanently joined to the upper face of the base plate 500. In an embodiment, the frame 2800 is biased towards the extended position.

In a further embodiment, the lower end of each rib 1900 may be individually joined to the upper face of the base plate 500. In this embodiment, each rib 1900 may be integral with the base plate 500 or each rib 1900 may be fastened to the upper face of the base plate 500. In yet another embodiment, each rib 1900 may be pivotally joined to the upper face of the base plate 500. In an embodiment, the ribs 1900 are individually biased towards the extended position.

In an embodiment, the ribs 1900, whether individually joined to the upper face of the base plate 500 or comprised within a frame 2800 that is joined to the upper face of the base plate 500, are joined to the upper face of the base plate 500 such that the portion of the each rib 1900 extending upward from the upper surface of the base plate 500 meets the base plate 500 at a position that is spaced inward from the outer edge of the base plate 500. For example, the portion of the each rib 1900 extending upward from the upper surface of the base plate 500 may be joined to the upper surface of the base plate 500 at a position that is spaced inward from the outer edge of the base plate 500 by a distance that is sufficient to allow the upper stop 502 and lower stop 504 to engage the outer portion of the base plate without engaging the ribs 1900 at the point where each rib 1900 extends upward from the upper surface of the base plate 500. In another embodiment, each rib 1900 may extend upward from the upper surface of the base plate 500 at a position that is spaced inward from the outer edge of the base plate 500 by a distance greater than or equal to about 1%, 2.5%, 5%, 7.5%, 10%, 12.5%, 15%, 17.5%, 20%, or more of the width of the base plate 500.

In another embodiment, the ribs 1900 may be unbiased. In this embodiment, movement of the ribs 1900 from the collapsed to the extended position may be effected by gravity or upon application of pressure to push the ribs 1900 towards the extended position. For example, a user could manually push the ribs 1900 into the extended position after pulling upwards on the pull rod 202 to release the outer wall of the funnel body 101 from engagement with the housing 100. Movement of the ribs 1900 to the collapsed position could be effected by pushing on the pull rod 202 to bring the ribs 1900 into engagement with the housing 100 or by manually applying pressure to the ribs 1900 to move the ribs 1900 from the extended position into the collapsed position.

The membrane 1902 may comprise any suitable material as will be understood to one skilled in the art, and may be selected based upon the nature of the substance to be transferred through the funnel body 101. Examples of suitable materials include, but are not limited to, metal, plastic, rubber, fiberglass, and/or a fabric such as canvas. When the membrane 1902 comprises fabric and is intended for use to transfer a liquid, the fabric should be leak-proof or teak-resistant. Suitable metals include, but are not limited to, stainless steel, mild steel, brass, bronze, copper, titanium, and aluminum.

In an embodiment, the membrane 1902 is a deformed membrane, such that the membrane 1902 is self-biased to return to a particular arrangement each time the outer wall of the funnel body 101 returns to the collapsed position. For example, the membrane 1902 may be self-biased to form a shaped lobe between each rib 1900 or the membrane 1902 may be self-biased towards an accordion fold. In this embodiment, the membrane 1902 is preformed and deformed such that it suits the fully extended position and is predisposed so that when tension on the membrane 1902 is relaxed, the internal forces of the membrane 1902 cause it to fold back in on itself to aid in the collapsing and retraction of the funnel body 101.

Figure 19:
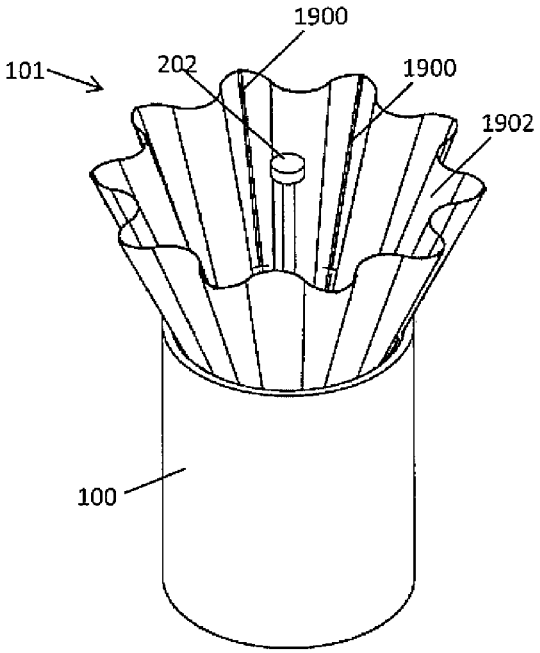
FIG. 19 depicts a perspective view of the funnel assembly of FIG. 18, with the funnel in a partially extended position.
Figure 20:
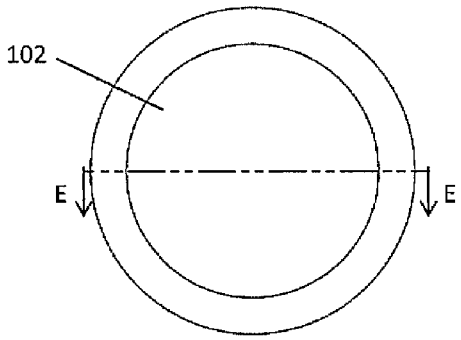
FIG. 20 depicts a top plan view of the funnel assembly of FIG. 18.
Figure 21:
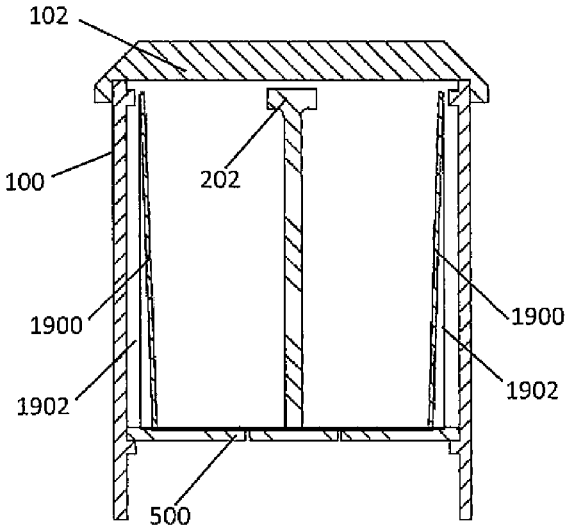
FIG. 21 depicts a sectional view of the funnel assembly of FIG. 18, sectioned along line E as shown in FIG. 20.
Figure 22:
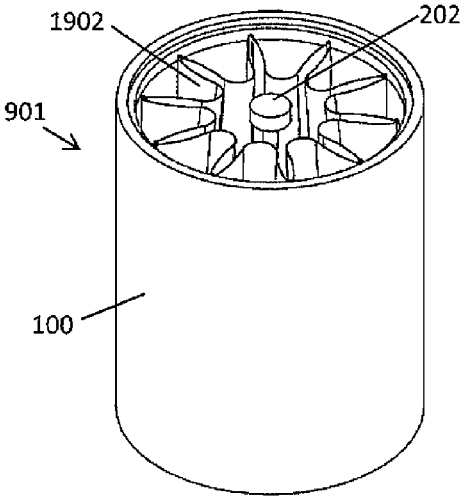
FIG. 22 depicts a perspective view of the funnel assembly of FIG. 18, with the funnel in the retracted position.
Figure 23:
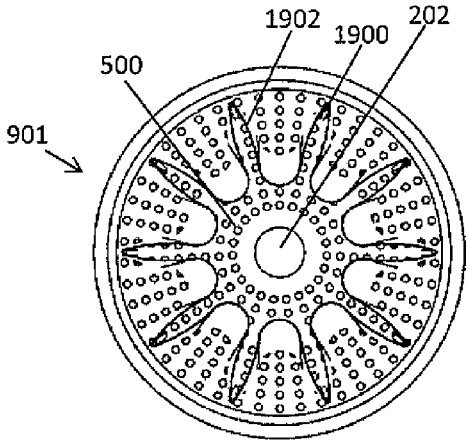
FIG. 23 depicts a top plan view of the funnel assembly of FIG. 18, with the funnel in the retracted position.
Figure 24:
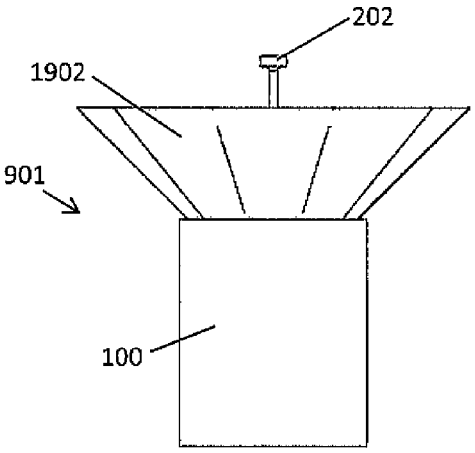
FIG. 24 depicts an elevation view of the funnel assembly of FIG. 18, with the funnel in the extended position.
Figure 25:
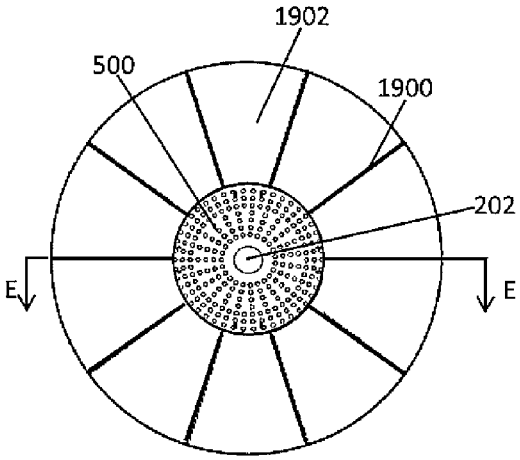
FIG. 25 depicts a top plan view of the funnel assembly of FIG. 18, with the funnel in the extended position.
Figure 26:
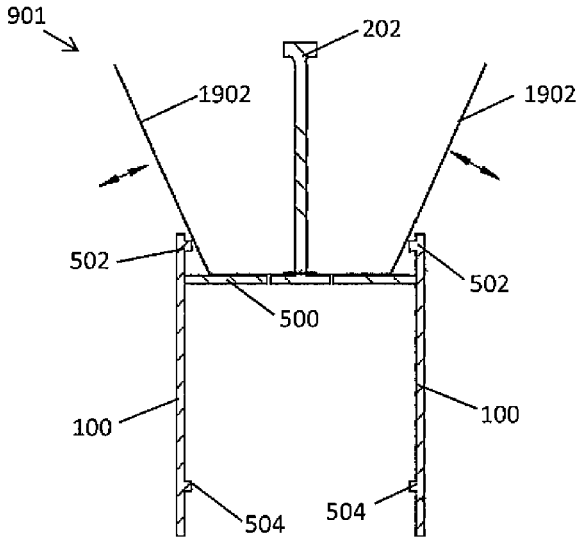
FIG. 26 depicts a sectional view of the funnel assembly of FIG. 18, with the funnel in the extended position, sectioned along line E as shown in FIG. 25.
Figure 27:
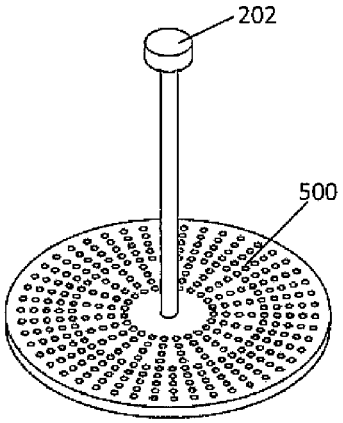
FIG. 27 depicts a partial view of the funnel assembly of FIG. 1 or 18, detailing the base plate and the pull rod.

FIGS. 22 and 23 depict the second embodiment of the funnel body 101 in a retracted position, FIG. 19 depicts the funnel body 101 in a partially extended position, and FIGS. 24-26 depict the funnel in an extended position. The structure of the funnel body 101 in the partially extended position is further detailed further in FIG. 29, while FIG. 30 details the membrane in the collapsed position.

The range of motion for the ribs 200 of the funnel body 101 between the retracted and extended positions may be limited to a predetermined range, such that the ribs 200 cannot move outward beyond a predetermined extended position and/or inward beyond a predetermined retracted position. For example, the angle of the ribs 200 relative to the longitudinal axis of the pull rod 202 may range from zero to less than 90 degrees, between the collapsed and extended positions, including all ranges between these values. In an embodiment, the angle of the ribs 200 relative to the longitudinal axis of the pull rod 202 may be between zero to about 20 degrees in the collapsed position and between about 30 to about 65 degrees in the extended position. These values are provided merely as examples and it is to be understood that the angles of the ribs 200 in the collapsed and extended positions may be selected from any suitable angle as desired or as required to suit any particular flowable good with which the funnel body 101 is intended for use.

In non-illustrated embodiments, the outer wall of the funnel body 101 may comprise another collapsible funnel-shaped structure as will be understood to one skilled in the art. For example, the outer wall may comprise a preformed material that is sufficiently rigid to be self-supporting, that is preferably self-biased towards the extended position, and that is sufficiently resilient to flex between the collapsed position and the extended position. For example, the outer wall of the funnel body 101 may comprise a resilient material such as rubber, for example silicone rubber, or plastic having a hollow frustoconical shape, with the narrow end of the outer wall joined to the upper surface of the base plate 500. In this embodiment, there is no need for a frame 2800 to support the outer wall, though a frame 2800 may optionally be employed. In an embodiment, the outer wall of the funnel body 101 may be joined to the upper surface of the base plate 500 at a position that is spaced inward from the outer edge of the base plate 500. For example, the outer wall of the funnel body 101 may be joined to the upper surface of the base plate 500 at a position that is spaced inward from the outer edge of the base plate 500 by a distance that is sufficient to allow the upper stop 502 and lower stop 504 to engage the outer portion of the base plate without engaging the outer wall of the funnel body 101 at the position where the outer wall is joined to the upper surface of the base plate 500. In another embodiment, the outer wall may be joined to the upper surface of the base plate 500 at a position that is spaced inward from the outer edge of the base plate 500 by a distance greater than or equal to about 1%, 2.5%, 5%, 7.5%, 10%, 12.5%, 15%, 17.5%, 20%, or more of the width of the base plate 500.

The base plate 500 is preferably a substantially circular base plate comprising at least one aperture to allow a fluid to pass through said base plate 500 and further comprising an upper face and a lower face. In the illustrated embodiment, the base plate 500 comprises a plurality of perforations distributed over the base plate 500, forming a screen to prevent solid matter larger than the perforations from passing through the base plate 500. In non-illustrated embodiments, the base plate 500 may comprise at least one larger aperture that does not form a screen, but rather allows liquid and solid matter smaller than the aperture to pass through the base plate 500.

The funnel body 101 further comprises a pull rod 202 that is joined to the base plate 500, allowing a user to move the funnel body 101 in the longitudinal direction relative to the length of the housing 100 by pulling or pushing on the pull rod 202. In an embodiment, the pull rod 202 is joined to the base plate 500 substantially at the center of the base plate 500, though the pull rod 202 could be joined to the base plate 500 at any position that allows the pull rod 202 to be readily grasped by a user and in which the pull rod 202 does not impede the outer wall of the funnel body 101 from moving between the collapsed and extended positions. The pull rod 202 may be fastened to the base plate 500 or integral with the base plate 500. In an embodiment, the height of the pull rod 202 is equal to or less than the height of the outer wall of the funnel body 101 in the collapsed position, as measured from the upper surface of the base plate 500 to the upper edge of the outer wall.

The pull rod 202 and base plate 500 may both comprise the same material or the pull rod 202 and base plate 500 may comprise different materials. The base plate 500 should comprise a material that is suitably rigid to allow movement of the base plate 500 to be arrested by engagement with an upper stop 502 or lower stop 504 joined to the inner surface of a housing 100 when the base plate 500 of the funnel body 101 is housed within said housing 100. Suitable materials for the base plate 500 will be understood to one of skill in the art and include but are not limited to; metal, plastic, ceramic, glass, composite materials, fiberglass, wood, and dense rubber.

A funnel assembly 901 comprises a funnel body 101 and a housing 100. The housing 100 comprises a side wall, said side wall having an inner surface and an outer surface. The housing 100 further comprises an upper end; a lower end; an upper end portion; a lower end portion; and a length extending in the longitudinal direction between the upper and lower ends. In an embodiment, the housing 100 is substantially cylindrical. Joined to the upper portion of the inner surface of the side wall is at least one upper stop 502 and joined to the lower portion of the inner surface of the side wall is at least one lower stop 504. In the funnel assembly 901, the base plate 500 of the funnel body 101 is housed within the housing 100 and situated longitudinally between the at least one upper stop 502 and the at least one lower stop 504. The upper stop 502 and lower stop 504 serve to prevent the base plate 500 from exiting the housing 100 by engaging the base plate 500 as it is moved longitudinally towards the upper or lower end of the housing 100 and thereby preventing the base plate 500 from moving longitudinally beyond the upper stop 504 or the lower stop 502.

In an embodiment, the upper 502 stop and/or lower stop 504 is a ridge or protrusion that projects from the inner surface of the housing substantially around its periphery. In another embodiment the upper 502 and/or lower 504 stop is a tab or other protrusion that does not extend around the entire periphery of the inner surface. In a further embodiment one or more of the stops 502, 504 may be positionable from a retention position to a release position through retraction into the side wall of the housing, by repositioning of the stop 502, 504, or by removal of the stop 502, 504 from the housing, allowing the funnel body 101 to be removed from the housing when the stop 502, 504 is in the release position; for example to allow cleaning, repair, or replacement of the funnel body 101. For example, the stops 502, 504 may comprise a retractable fastener such as a spring loaded pin or other fastener that can be retracted into the wall of the housing to permit removal of the funnel body 101 from the housing 100. One or more of the stops 502, 504 could also be mechanically fastened to the inner surface of the housing 100 by a releasable fastener that allows for installation and removal of the stops 502, 504. For example, one or more of the stops 502, 504 may be fastened to the inner surface of the housing by a spring clip, threaded fastener, or other releasable fastener as will be understood to one skilled in the art.

The housing 100 may comprise a single upper stop 502 and a single lower stop 504 or it may comprise a plurality of upper stops 502 and/or a plurality of lower stops 504 positioned around the periphery of the inner surface of the housing 100. When the housing 100 comprises a plurality of upper stops 502, the upper stops 502 will preferably be positioned at substantially the same distance along the longitudinal axis, such that the base plate 500 engages all of the upper stops 502 simultaneously when moving longitudinally towards the upper end of the housing 100. Similarly, when the housing 100 comprises a plurality of lower stops 504, the lower stops 504 will preferably be positioned at substantially the same distance along the longitudinal axis, such that the base plate 500 engages all of the lower stops 504 simultaneously when moving longitudinally towards the lower end of the housing 100.

The upper stop 502 should be positioned sufficiently close to the upper end of the housing 100 to allow the base plate 500 to move close enough to the upper end of the housing in the longitudinal direction to allow the outer wall of the funnel body 101 to extend beyond the upper end of the housing 100 into the fully extended position. Similarly, the lower stop 504 should be positioned sufficiently distant from the upper end of the housing 100, in the longitudinal direction, to allow the base plate 500 to move sufficiently towards the lower end of the housing 100 in the longitudinal direction to allow the funnel body 101 to retract fully within the housing 100. Further, the lower stop 504 will preferably be sufficiently close to the upper end of the housing in the longitudinal direction to prevent the funnel body 101 from retracting so deeply into the housing 100 that it would be difficult for a user to reach and grasp the pull rod 202 by hand, thereby making it difficult for a user to move the funnel body 101 from the retracted position to the extended position. In an embodiment, the upper stop 502 and lower stop 504 may be relatively positioned such that the upper end of the outer wall of the funnel body 101 is maintained at or above the upper stop 502 when the funnel body 101 is in the fully retracted position, i.e. the base plate 500 is engaged with the lower stop 504, in order to prevent the upper end of the outer wall of the funnel body 101 from catching on the upper stop whenever the funnel body 101 is moved from the retracted position to the extended position.

As discussed previously, the outer wall of the funnel body 101 may be biased towards the extended position. When the funnel body 101 is housed within a housing 100, pushing or pulling on the pull rod 202 causes the funnel body 101 to move longitudinally within the housing 100. When the funnel body 101 is in the extended position, a user may push on the pull rod 202 to move the funnel body 101 towards the lower end of the housing 100. As the base plate 500 moves towards the lower end of the housing 100, the upper end of the side wall of the housing engages the outer wall of the funnel body 101, causing the outer wall of the funnel body 101 to move inwards towards the collapsed position. The outer wall of the funnel body 101 is maintained in the collapsed position by engagement with the inner surface of the side wall of the housing 100 as the funnel body 101 retracts into the housing 100, moving longitudinally towards the lower end of the housing 100. Conversely, when the funnel body 101 is in the retracted position, a user may pull on the pull rod 202 to move the funnel body 101 longitudinally towards the upper end of the housing 100. As the funnel body 101 moves longitudinally towards the upper end of the housing 100, the outer wall of the funnel body 101 exits, or partially exits, the housing 100, thereby becoming disengaged, or partially disengaged, from the inner surface of the side wall of the housing 100. When the outer wall of the funnel body 101 is biased towards the extended position, the disengagement from the housing 100 allows the outer wall of the funnel body 101 to automatically move into the extended position.

As discussed previously, the position at which the leaves 200 or the upward extending portion of the ribs 1900 joins the upper surface of the base plate 500 may be spaced inward from the outer edge of the base plate 500, such that the lower end of the outer wall is spaced inward from the outer edge of the base plate. This arrangement allows the outer wall of the funnel body 101 to begin moving towards the extended position as soon as the upper end of the outer wall of the funnel body 101 exits the housing 100. This arrangement further eliminates a need for the entire outer wall of the funnel body 101 to exit the housing 100 to enable the outer wall of the funnel body 101 to move into the fully extended position. This allows for the funnel body 101 to have a short throw relative to a funnel body 101 having an outer wall joined to the base plate 500 at the periphery of the base plate 500. A short throw is advantageous when the position or configuration of the receptacle requires the use of a short housing 100, therefore limiting the possible distance between the upper 502 and lower 504 stops.

In an embodiment, the housing 100 may be formed by a portion of a receptacle. For example, the housing 100 may be formed by a neck or spout of a receptacle; said neck or spout arranged to include at least one upper stop 502 and at least one lower stop 504. In another embodiment, the housing 100 may be preformed within the mouth of a receptacle such that the body of the housing 100 is largely contained within the receptacle, for example as shown for receptacle 3100 in FIG. 33. In another embodiment, the funnel assembly 901 may comprise a housing 100 that can be inserted into an opening; such as a mouth, neck, or spout; within an existing receptacle. Upon insertion into the receptacle, the housing 100 may further be joined to the opening within the receptacle; for example by using a fastener, adhesive, and/or friction to secure the housing 100 in place within the opening of the receptacle.

The funnel assembly 901 may be used together with any type of receptacle into which a user may wish to pour a flowable good, such as a liquid or powder. Examples of such receptacles include, but are not limited to; bottles, jars, canisters, jugs, cans, drums, vehicle fluid reservoirs, processing equipment reservoirs, industrial equipment reservoirs, and filler pipes. Examples of vehicle fluid reservoirs include engine coolant reservoirs, brake fluid reservoirs, transmission fluid reservoirs, washer fluid reservoirs, hydraulic fluid reservoirs, and engine lubricant reservoirs. The funnel assembly 901 is particularly useful for receptacles housing goods that need to be topped up on a regular basis and/or for receptacles that are intended to house goods for which cross-contamination is a particular concern. The funnel assembly 901 of the disclosure is intended for use in combination with a single receptacle, ensuring a singular use and application. Since each fluid transfer need is intended to have its own specific funnel assembly 901 waiting for use, the overall design of the funnel assembly 901 including material, physical geometry, and slope can be customized and optimized for that particular need and function.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments.

Further, while the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting. It will be understood by persons skilled in the art that other variants and modifications may be made without departing from the scope of the invention as defined in the appended claims.

What is claimed is:

1. A funnel assembly comprising:

(a) a housing having a side wall, said side wall having an inner surface and an outer surface; an upper end; a lower end; an upper end portion; a lower end portion; and a length extending along the longitudinal axis between the upper end and the lower end;

(b) at least one upper stop within the upper end portion of the inner surface of the housing;

(c) at least one lower stop within the lower end portion of the inner surface of the housing; and (d) a funnel body which is supported in the housing for longitudinal sliding movement, the funnel body comprising:

(i) a base plate having an upper surface, a lower surface, and an outer edge, said base plate comprising at least one opening to allow passage of a liquid through said base plate;

(ii) a pull rod joined to the base plate; and (iii) an outer wall joined to the upper surface of the base plate which is movable between an extended position operable as a funnel and a collapsed position which is collapsed relative to the extended position so as to be storable within the housing, wherein (e) the base plate of the funnel body is situated within the housing between the upper and lower stops such that the base plate is free to slide longitudinally within the housing between the upper and lower stops but is prevented from moving beyond the upper and lower stops by engagement with the upper and lower stops;

(f) movement of the base plate towards the upper end of the housing allows the outer wall of the funnel body to extend from the upper end of the housing such that the outer wall is moveable from the collapsed position to the extended position;

(g) movement of the base plate towards the lower end of the housing allows the outer wall of the funnel body to retract within the housing from the extended position to the collapsed position; and (h) the outer edge of the base plate is in contact with the inner surface of the housing along a full length of the outer edge of the base plate, thereby inhibiting liquid from passing between the outer edge of the base plate and the inner surface of the housing.

2. The funnel assembly of claim 1, wherein the upper stop is positionable between a retention position in which the at least one upper stop is positioned to engage the base plate as the base plate is moved longitudinally towards the upper end of the housing and a release position in which the at least one upper stop is positioned to not engage the base plate as the base plate is moved longitudinally towards the upper end of the housing, thereby allowing the funnel to be removed from the housing when the upper stop is in the release position.

3. The funnel assembly of claim 1, wherein the position at which the outer wall is joined to the upper surface of the base plate is spaced inward from the outer edge of the base plate.

4. A funnel assembly comprising:

(a) a housing having a side wall, said side wall having an inner surface and an outer surface; an upper end; a lower end; an upper end portion; a lower end portion; and a length extending along the longitudinal axis between the upper end and the lower end;

(b) at least one upper stop within the upper end portion of the inner surface of the housing;

(c) at least one lower stop within the lower end portion of the inner surface of the housing; and (d) a funnel body which is supported in the housing for longitudinal sliding movement, the funnel body comprising:

(i) a base plate having an upper surface, a lower surface, and an outer edge, said base plate comprising at least one opening to allow passage of a liquid through said base plate;

(ii) a pull rod joined to the base plate; and (iii) an outer wall joined to the upper surface of the base plate which is movable between an extended position operable as a funnel and a collapsed position which is collapsed relative to the extended position so as to be storable within the housing, wherein (e) the base plate of the funnel body is situated within the housing between the upper and lower stops such that the base plate is free to slide longitudinally within the housing between the upper and lower stops but is prevented from moving beyond the upper and lower stops by engagement with the upper and lower stops;

(f) movement of the base plate towards the upper end of the housing allows the outer wall of the funnel body to extend from the upper end of the housing such that the outer wall is moveable from the collapsed position to the extended position;

(g) movement of the base plate towards the lower end of the housing allows the outer wall of the funnel body to retract within the housing from the extended position to the collapsed position; and (h) the position at which the outer wall is joined to the upper surface of the base plate is spaced inward from the outer edge of the base plate.

5. A funnel assembly comprising:

a housing having a side wall, said side wall having an inner surface and an outer surface; an upper end; a lower end; an upper end portion; a lower end portion; and a length extending along the longitudinal axis between the upper end and the lower end;

a funnel body which is supported in the housing for longitudinal sliding movement, the funnel body comprising:

(i) a base plate having an upper surface, a lower surface, and an outer edge, said base plate comprising at least one opening to allow passage of a liquid through said base plate;

(ii) a pull rod joined to the base plate; and (iii) an outer wall joined to the upper surface of the base plate which is movable between an extended position operable as a funnel and a collapsed position in which the outer wall is radially collapsed relative to the extended position so as to be storable within the housing;

wherein the base plate of the funnel body is situated within the housing between the upper and lower ends such that the base plate is free to slide longitudinally within the housing between the upper and lower ends;

wherein movement of the base plate towards the upper end of the housing allows the outer wall of the funnel body to extend from the upper end of the housing such that the outer wall is moveable from the collapsed position to the extended position;

wherein movement of the base plate towards the lower end of the housing allows the outer wall of the funnel body to retract within the housing from the extended position to the collapsed position; and wherein the outer wall comprises a plurality of first leaves and a plurality of second leaves which are rigid and self-supporting in the extended position;

each first leaf being supported on the base plate at a first radial distance relative to a center of the base plate and so as to be circumferentially spaced apart from other ones of the first leaves in the extended position;

each second leaf being supported on the base plate at a second radial distance relative to the center of the base plate which is greater than the first radial distance and so as to be circumferentially spaced apart from other ones of the second leaves in the extended position; and each second leaf spanning a circumferential gap between a respective adjacent pair of the first leaves in an overlapping configuration with an outer side of each first leaf of the adjacent pair of the first leaves such that the first and second leaves form a continuous wall that extends upward from the upper face of the base plate in the extended position.

* * * * *